United States Patent [19]

Horn et al.

[11] Patent Number: 4,941,132

[45] Date of Patent: Jul. 10, 1990

[54] REVERSING BLENDER AGITATORS

[75] Inventors: Darrell C. Horn, Lafayette; John M. Lennox, III, Sebastopol, both of Calif.

[73] Assignee: Blentech Corporation, Calif.

[21] Appl. No.: 347,443

[22] Filed: May 4, 1989

[51] Int. Cl.[5] ..... B01F 11/00; B01F 7/08

[52] U.S. Cl. ..... 366/278; 366/300; 366/301; 366/320

[58] Field of Search ..... 366/297, 298, 299, 300, 366/301, 276, 277, 320, 85, 84, 66, 64, 278; 425/207, 208

[56] References Cited

U.S. PATENT DOCUMENTS 4,474,475 10/1984 Moriyama ..... 366/301

4,792,294 12/1988 Mowli ..... 366/85

*Primary Examiner*—Robert W. Jenkins

*Attorney, Agent, or Firm*—Phillips, Moore, Lempio & Finley

[57] ABSTRACT

Improved methods of operating batch or continuous blenders (10) having a tub (11) and twin agitators (17,18) extending parallel to each other, each agitator having a horizontal shaft (19) and an agitator ribbon (12) wound helically around the shaft. For batch blending, the two agitator ribbons are wound in the same direction around the shafts, and the shafts are rotated in opposite directions for folding the product into the middle of the tube for mixing. The agitators are periodically reversed in direction of operation to prevent the build-up of product at the end corners (36,37) of the tub and the consequent mechanical breakdown of ingredients which has occurred with previous blenders. For continuous blending to be carried out in a tub with twin agitators, the agitator ribbons are wound in opposite directions on their shafts. The agitators are rotated in opposite directions to fold the product into the center of the tub for mixing, with both agitators moving the product in the same direction lengthwise of the tub. The direction of rotation of the agitators is periodically reversed, with the time of reversed operation in each cycle being less than the time of forward operation, so that the product as a whole progressively moves toward the discharge end (14) of the blender as the product is being mixed.

21 Claims, 2 Drawing Sheets

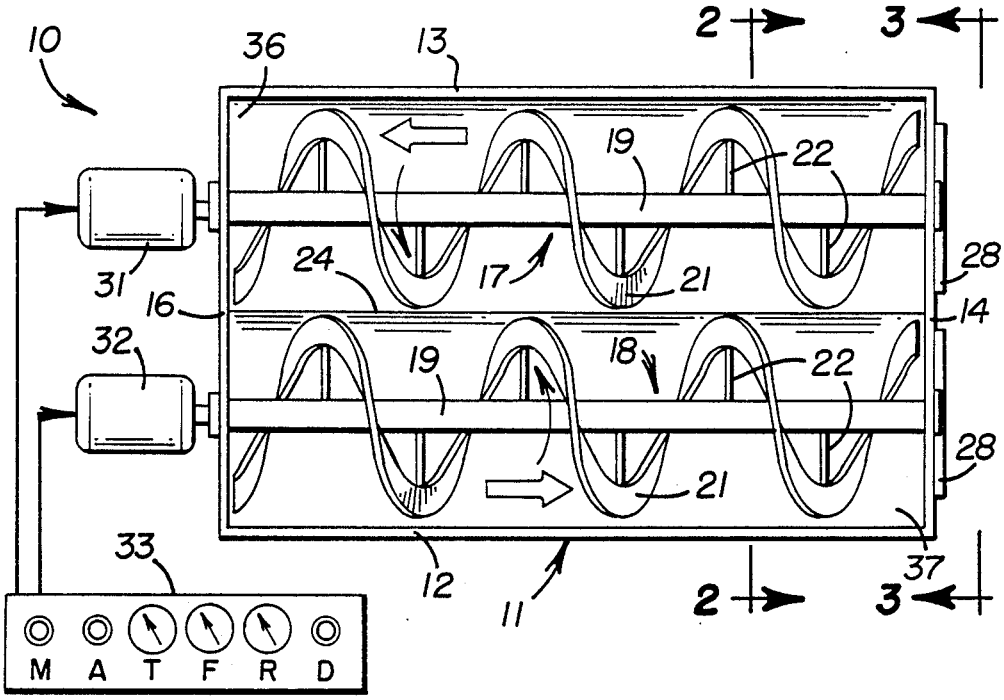
FIG. 1
FIG. 2
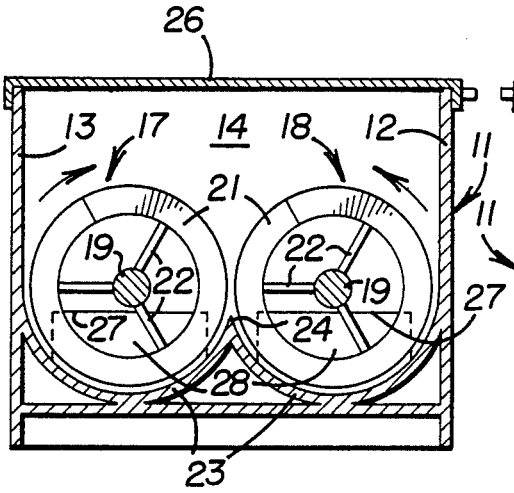
FIG. 3
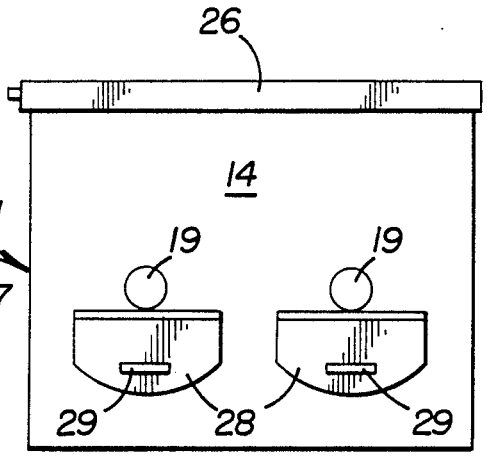

FIG. 4
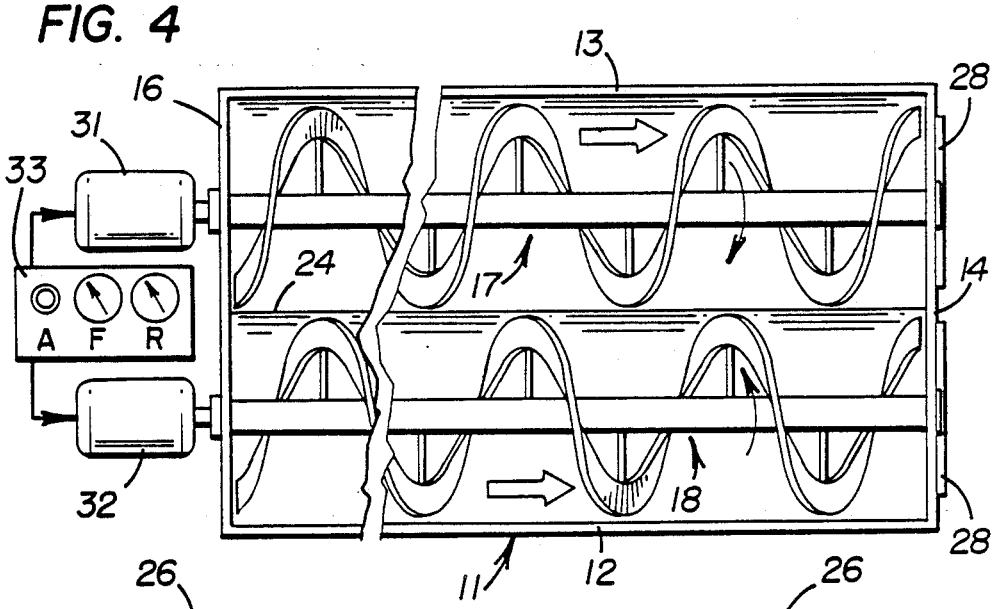
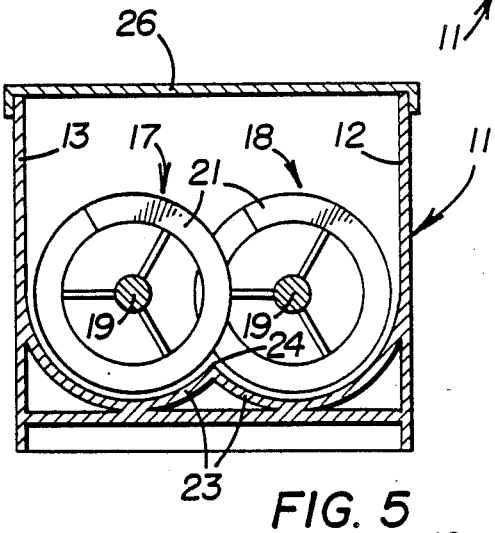
FIG. 5
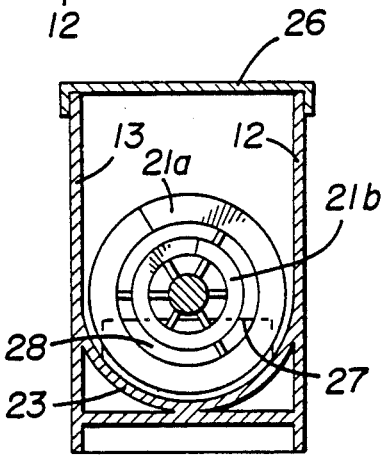
FIG. 7
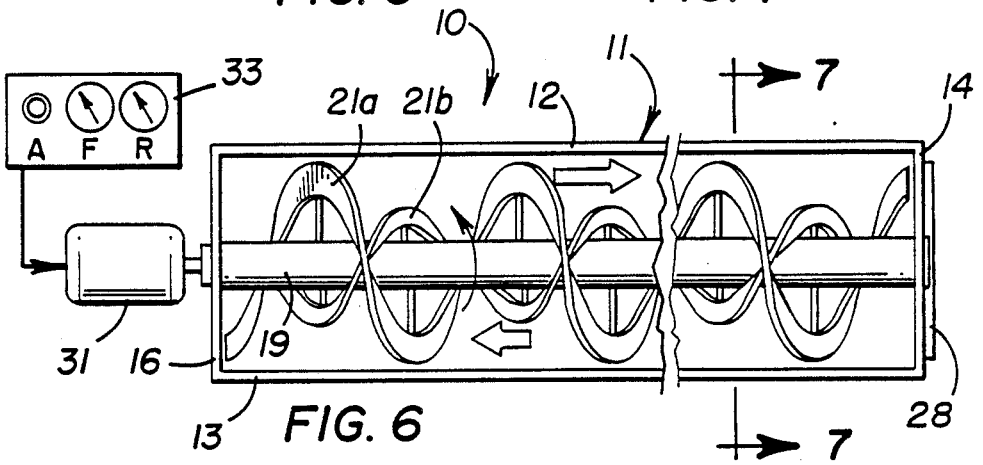
FIG. 6

REVERSING BLENDER AGITATORS

BACKGROUND OF THE INVENTION

This invention relates to the blending of particulated food products, and more particularly to a method of blending such products using agitators mounted on elongated, horizontal rotatable shafts.

Blending machines having one or more horizontal agitator shafts positioned in an elongated tub are in common use in the blending of particulated food products such as different mixtures of diced or ground meat, poultry, vegetables, sauces and the like. The most commonly used machine is a twin shaft blending machine, wherein two horizontal agitator shafts are mounted in a tub parallel to each other. The agitators mounted on the shafts come in many designs, with the most common being a ribbon agitator wherein a spiral ribbon of steel is mounted on each shaft by spokes extending radially from the shafts.

As the agitator shafts rotate, the spiral ribbons push through the product causing it to move in a rotating column with the agitator, and, because the ribbons are spiral, to move slowly in a direction parallel to the agitator shafts, i.e. from end-to-end in the tub. Typically, the agitators are rotated in opposite directions so that the product is moved in opposite end-to-end directions in the tub by each agitator, with the product being continuously folded into the center of the tub by each counter-rotating agitator so that the two rotating columns mix with each other.

After the blending has been carried on sufficiently to mix the product to a desired degree, one of the agitator shafts is reversed in direction of rotation. This causes both agitators to urge the product towards the discharge end of the tub and out through the discharge doors at that end of the tub.

An example of such a blending machine is that shown in U.S. Pat. No. 4,733,607, issued Mar. 29, 1988 to Leonard J. Star and Jesse J. Tapscott. In this patent, the apparatus also includes a steam jacket surrounding the blending tub so that the product can be cooked as the agitators mix and blend the product together. Also, in the patent the spiral ribbons have scrapers mounted thereon for scraping the trough walls to keep the product from sticking on the hot cooking surfaces. Ribbon blender machines used for cold blending will not have a steam jacket, nor will the scrapers shown in the above patent be required.

These blenders are used for batch operations, wherein the particulated ingredients are loaded into the tub, generally to a level just above the top of the spiral ribbon, and the agitator shafts are then driven.

The ribbon agitators may be made in different shapes. For example, instead of being in a flat rectangular shape, as in the above mentioned U.S. Pat. No. 4,733,607, the ribbons may be round or tubular in cross-section. The ribbons may also be non-continuous and made of several short sections along the length of the agitator shafts. For some products, paddles of different shapes are attached to the agitator shaft in place of the ribbons, the paddles being oriented to have their faces inclined to the axes of rotation. Sometimes, the agitator may be made up a combination of ribbons and paddles. Regardless of the specific designs, the action will be the same, i.e. the agitators will cause the product in contact therewith to move towards the center of the tub for blending and also lengthwise of the tub.

Ribbon agitators have also been used in continuous blenders, i.e. blenders in which the ingredients are continually added at one end of the blender and with the blended product being continuously removed from the other end of the blender. Such continuous blenders have a substantially elongated tub or trough and a horizontal shaft extending the length of the tub. The shaft has inner and outer spiral ribbons along the length thereof, of the shaft. One of the ribbons being wound as a right hand spiral while the other ribbon is wound as a left hand spiral. Thus when the shaft is rotated, the outer ribbon will urge the product towards the discharge end of the tub while the inner ribbon urges the product in the opposite direction towards the inlet end of the tub. This counter movement provides the blending of the product as the total product moves gradually as a whole towards the discharge end.

Continuous blenders currently in use are successful only if the separate ingredients are fed into the blender in exactly the right proportion and continuously. Such continual metering of the ingredients is difficult and few plants are set up for this. Further, this system will work only on products that are very easy to mix, such as fruit or salad mixes without sticky dressings. Because of these limitations, few continuous blenders are in use.

The twin horizontal shaft batch blenders also have their limitations. The most significant problem is the amount of mechanical damage that the agitators cause to the product as it is blended. To provide a pack with high quality appearance, the different ingredients must be uniformly blended together with a minimum amount of mechanical breakdown of any one of the ingredients. If the product is a sauce-based blend of particles, such as stew, the objective is to keep the particles of meat and vegetables in suspension during blending and with minimum damage to the softer vegetable ingredients of the stew. If the product is also cooked as it is being blended, many of the ingredients will become very fragile as they get closer to being fully cooked and will break down very easily. When ground beef is cooked, as for example for taco meat, it is desirable to end up with an evenly cooked product with natural looking, irregular sized chunks of meat. When cooked in a jacketed blender with a conventional agitator system, the meat is broken into universally small particles and has an unnatural mealy look when cooked.

SUMMARY OF THE INVENTION

It is an object of the invention to overcome the shortcomings described above and to provide a method of blending which will substantially reduce the mechanical damage to ingredients being blended and which will also enable continuous blending to be carried out on products which cannot now be continuously blended.

It has been discovered that the main cause of mechanical breakdown of the particles is a breakdown of the fragile food products at the forward end of each agitator shaft. Since all blender agitators rotate continuously in one direction, the product will be moved by the two agitators lengthwise of the blender tub and in opposite directions. As the forward ends of the two columns of product reach the ends of the blender they must transfer from one side of the blender tub to the other. This transfer is inherently inefficient, and, as a result, the particles in the product tend to build up in opposite corners of the tub and most of the mechanical damage to the product will result while the particles are in these corners and before they are transferred to the opposite side.

In order to reduce this damage, and in accordance with the present invention, the directions of rotation of the agitator shafts are repeatedly reversed during blending, instead of the shafts being rotated continuously in one direction. Such periods of reversals of agitator rotation will prevent the undesirable build-up of the product in the corners of the blender and will eliminate a substantial portion of the mechanical damage to the product that has previously occurred.

Another aspect of the invention is that the periodic reversal of agitator rotation enables continuous blending to be carried out with a twin agitator shaft system, wherein the two agitator ribbons are oppositely spiraled and oppositely rotated to provide efficient folding of the product into the middle of the blender while both ribbons move the product in the same direction. For each full cycle of reversing operation, the agitators move the product incrementally towards the discharge end of the blender tub.

Additional objects, advantages and novel features of the invention will be set forth in the description which follows, and in part will become apparent to those skilled in the art upon examination of the following, or may be learned by practice of the invention. The objects and advantages of the invention may be realized and attained by means of the instrumentalities and combinations pointed out in the appended claims.

BRIEF DESCRIPTION OF THE DRAWINGS

The accompanying drawings, which are incorporated in and form a part of the application, together with the description, serve to explain the principles of the invention.

FIG. 1 is a simplified view, in plan, with cover removed, of a twin horizontal agitator shaft batch blender.

FIG. 2 is an elevational sectional view of the blender in FIG. 1, taken on lines 2—2 thereof.

FIG. 3 is an elevational view of the discharge end of the blender of FIG. 1, as seen from line 3—3 thereof.

FIG. 4 is a simplified plan view, with cover removed, of a twin horizontal agitator shaft continuous blender.

FIG. 5 is a sectional elevational view of an intermeshing agitator ribbon arrangement.

FIG. 6 is a simplified plan view, with cover removed, of a single agitator shaft continuous blender.

FIG. 7 is a elevational sectional view of the blender of FIG. 6, taken on line 7—7 thereof.

DESCRIPTION OF THE PREFERRED EMBODIMENTS

Batch Blenders

Referring now to the drawings, wherein preferred embodiments of the invention are shown, and in particular to FIGS. 1-3, the blender 10 comprises a tub 11 having side walls 12 and 13, a discharge wall 14 and an opposite end wall 16, and two horizontal and parallel agitators 17 and 18 extending from end-to-end of tub 11. Each agitator has a horizontal shaft 19 and a spiral ribbon 21 of steel supported on the shaft by radially extending spokes 22. As seen in FIG. 2, the bottom of the tub 11 is formed as two circular arcuate troughs 23 meeting in a cusp 24, the troughs having radii slightly greater than the outer radii of the agitator ribbons 21. A top cover 26 encloses the blender.

The discharge end wall 14 has discharge openings 27 therethrough which are closed during blending operations by doors 28. The doors 28 are hinged to end wall 14 and are provided with handles 29 or the like so that they may open the tub for discharge after blending.

Agitators 17 and 18 are rotated by motors 31 and 32 which are suitably coupled to the agitator shafts 19. A control box 33 is electrically connected to the motors, and typically will have manual and automatic start-stop switches M and A, a timer T to control the total length of time of a blending operation, timers F and R to control the length of time of forward rotation and reverse rotation in a cycle of operation, and a discharge switch D.

Merely by way of illustration, a blender with a 2,000 pound capacity will have a tub with a length of 72 inches, a width of 46.5 inches and a height of 36 inches. The ribbons 21 will both be wound as right hand spirals, with a diameter of 23 inches and a pitch of 21 inches. The agitator will typically be driven at about 45 rpm., but the speed may vary therefrom depending on the nature of the product being blended.

In operation, the ingredients to be blended will be put into the tub, typically up to a level just above the tops of the agitator ribbons 21. The cover 26 is closed, and the automatic mode start switch A is actuated. This starts motors 31 and 32 to drive the agitator shaft 19 in opposite directions. When the shafts 19 are rotated in the directions indicated in FIGS. 1 and 2, the ribbon 21 of agitation 17 will urge the product to move in a direction away from the discharge end 14, while the agitator 18 will urge the product towards the discharge end 14, as indicated by the large, flow direction arrows in FIG. 1. The counter rotating agitators fold the products to the center of the tub, and along the length thereof, to cause the products in each trough to mix with the other.

If the agitators 17 and 28 were to be continuously driven in these directions, as in prior art blenders, the product would be forced into the corners 36 and 37 of the tub and the particulate would build up in those corners. These particulates must be lifted up from one trough 23 and over cusp 24 to the other trough 23. Most of the particulates at these points tend to follow the individual agitators and roll back into the corners rather than be pushed across to the trough on the other side of the tub. Eventually the products are transferred to the other side but are mechanically broken up in the process.

However, in accordance with the present invention, the control 33 functions when in the automatic mode to reverse the rotation of the agitators. By doing so, the build up in tub corners 36 and 37 is alleviated by pulling the particulates from those corners and distributing them along the length of the troughs 23 so that they may be folded efficiently into the center of the tub with the two columns of product being blended into each other.

If continued for too long, reverse rotation will, of course, cause product build up in the other two corners of the tub and subsequent damage to the ingredients. To prevent this, the control will again cause the directions of rotation of the two agitators to reverse. The reversing continues periodically, with the F and R timers of control 33 being set to determine how long the rotation in each direction shall continue before reversing. Preferably, the length of time of rotation in each direction is the same.

As previously mentioned, when cooking ground beef for taco meat in a conventional jacketed blender, the resultant product has an unnaturally mealy appearance. When cooked in accordance with the present invention, and with the agitators reversed every 15 seconds, the product is cooked faster and comes out with a natural, hand cooked appearance.

Hitherto, it was difficult to blend very sticky products, such ground beef with a high percentage of fat or ground chicken meat with ground chicken skin mixed in, since the product would often cling to the ribbon spokes framework and simply rotate with the agitator in two large logs. If this happens, no blending occurs and the product must be shoveled out of the blender. However, the automatic reversing agitation system keeps this from happening. Each time the agitator reverses itself, the meat becomes dislodged and begins to blend again.

The length of time before each reversal depends on the how fragile the product is. Since the product is not being mixed during the intervals that the agitators are stopping and restarting in the opposite direction, it is desirable that the interval of operation before reversal be relatively long. However, for any product, the time of operation before reversal must be set for the most fragile ingredient in the product.

For very fragile products, such as diced cooked chicken, cooked soft vegetables (zucchini, squash and the like) delicate pasta, etc., operation of the agitators in either direction should continue for only about five seconds before reversal. It has been found that a five-second interval is the least practical time because of the time required for reversing the agitators.

When a stew of diced beef and potatoes is cooked in a jacketed blender with reversing agitators, and with the agitators changing direction every 20–30 seconds, the beef and potatoes are cooked without significant mechanical breakdown.

Examples of products in which the agitators should be reversed in 50 seconds to a minute are products with chunks of beef, and less fragile vegetables such as carrots and green beans.

Operation in one direction for about one minute is the longest practical reversing interval before reversing. It has been found that if products are damaged in a twin agitator system, such damage will occur within a minute interval. If the product is not damaged within one minute, then reversing agitation is not necessary. In such case, the agitators should be run continuously in the same directions, as before, to avoid the non-mixing times of reversals. The control 33 should accordingly have a manual operation switch M to lock out the reversing function of the automatic switch S.

The total amount of time required to blend the ingredients to the desired degree will depend on the particular ingredients. Soft products, including, for example, cooked diced chicken, may require a total blending time of about five minutes. Tougher products, including, for example, beef chunks, may require ten minutes of blending.

After the product has been blended to a desired degree, the discharge switch D is actuated. This will cause motors 31 and 32 to rotate agitators 17 and 18 in the same direction so that they both urge the product towards the discharge end of the tub. The discharge doors 28 are opened, and the blended product is discharged through openings 27 to suitable containers or conveyors.

Continuous Blenders

The reversing agitator concept disclosed above in connection with the prevention of mechanical damage to the product in a batch blender also makes it practicable to provide a continuous blender for particulated products, including those which cannot now be mixed in the existing single shaft continuous blenders.

FIG. 5 illustrates a twin horizontal shaft agitator system in a continuous blender. The continuous blender of FIG. 5 is physically the same as the batch blender of FIG. 1 except: (a) the ribbons 21 of the two agitators 17 and 18 are wound in opposite directions around their shafts 19, so that one of the agitators is right-handed while the other is left-handed; (b) the lengths of the tub 11 and the agitators 27 and 18 are significantly longer; and, (c) the control box 33 has fewer controls.

In operation, the ingredients are continually added to the tub 11 at its left (as viewed in FIG. 5), or inlet, end. The two agitators are driven by motors 31 and 32 in opposite directions so that the ingredients will be folded into the center for mixing, as in a batch blender. However, since the two agitator ribbons 21 are oppositely wound, the opposite rotation of the agitators will cause both agitators to move the product in contact therewith in the same direction lengthwise of the tub.

As before, the direction of agitator rotation is periodically reversed. The product will now be moved in the opposite direction lengthwise of the tub. The forward (i.e. towards the discharge end of the tub) and reverse timers F and R are set so that in each cycle of operation the agitators will operate longer in the forward direction then in the reverse direction. Thus, the product will progress incrementally towards the discharge end of the tub.

The constant reversing of the agitators retains the product within the tub for a substantial time as it travels from inlet to discharge, and the folding of the ingredients to the center of the tub produces a blending of the ingredients in substantially the same manner as in a batch blender. Thus, difficult products which could only be blended in a batch blender can now be blended continuously.

The ratio of reverse time to forward time in each cycle of operation will vary depending on how difficult a product is to mix. The more difficult it is, the closer the time of operation in a reverse direction is to the time of forward operation. The percentage of reverse operating time, as a percentage of the forward operating time, will always be more than 25% and less than 100%.

For any particular product, the length of time the product is blended is substantially the same as if it were being batch blended. As a consequence, for agitators with the same pitch, the tub and agitators of a continuous blender should be longer than that of a batch blender. Typically, for relatively easy to mix products, the continuous blender tub should be about three times the length of a batch blender, while for relatively hard to mix products, the continuous blender tub should be about six times as long. With the proper choice of tub length and ratio of reverse to forward operation for a particular product, the blending time of the product in the continuous blender will be substantially the same as that in a batch blender.

A continuous blender can have several configurations. For example, the agitators can be spaced apart as shown in FIGS. 2 and 4 so that they do not intermesh.

In this configuration, the folding of the product into the center of the tub is much the same as in a batch blender.

With such configuration, the two agitators can be set up to reverse out of sequence with the other. Thus, for a part of the time in each cycle of operation, one agitator will be moving the product forwardly while the other agitator is moving the product in a reverse direction. This opposite movement will be set up a shearing of the product between the agitation, thereby increasing the mixing action.

Another agitation configuration is illustrated in FIG. 5, wherein the shafts 19 of the two agitators are closer to each other so that the ribbons 21 intermesh. This configuration is advantageous for very sticky products, since the intermeshing of the ribbons will keep the product from sticking to the agitators and rolling with them.

The advantages of the continuous blender are substantial. It is well established that continuous production systems are more efficient than batch systems. Most plants now have continuous systems, e.g. grinders, slicers, breading and battering lines, fryers, etc., on one or both sides of the blending systems. A continuous blender system would thus make many food production lines fully continuous.

FIGS. 6 and 7 illustrate an existing single agitator blender having a tub 11 with a single trough 23 and a single agitator extending the length of the trough. The single agitator shaft 19 has outer and inner ribbons 21*a* and 21*b* wound helically and oppositely along the shaft. As the shaft rotates, the two ribbons will urge the product in contact therewith to move in opposite directions lengthwise of the tub. The outer ribbon 21*a* has a greater surface area, and the shaft 19 is rotated in a direction so that the outer ribbon urges the product lengthwise of the blender towards the discharge end 14 thereof. Rotation of the shaft will cause mixing of the product because of the oppositely wound ribbons, with the product moving as a whole towards the discharge end of the blender.

As stated above, such a blender, with rotation of the agitator in a single direction, as in the past, will only work on products that are very easy to mix.

However, if such a blender is operated in accordance with the present invention, i.e. with periodic reversals of the direction of agitator rotation, the efficiency of blending will be markedly improved, since each ribbon acts on the product in contact therewith in both directions to cause a greater interaction and mixing of the products in contact with the two ribbons.

As in the twin agitator continuous blender, the direction of reversed travel in each cycle must be less than the direction forward movement so that there is a gradual overall movement of the product towards the discharge end. For a given length blender, the reversing system will retain the product in the blender than with the continuous rotation in one system as before. As a consequence, for a desired degree of blending, a single shaft agitation blender with reversing operation will be substantially shorter in length than before. Such blenders will be less expensive to manufacture and will also require less floor space.

The foregoing description of the preferred embodiments has been presented for purposes of illustration description. It is not intended to be exhaustive or to limit the invention to the precise forms described, and obviously many other modifications are possible in light of the above teaching. The embodiments were chosen in order to explain most clearly the principles of the invention and its practical applications thereby to enable others in the art to utilize most effectively the invention in various other embodiments and with various other modifications as may be suited to the particular use contemplated. It is intended that the scope of the invention be defined by the claims appended thereto.

I claim:

1. A method of blending particulated products in a blender tub having first and second opposed ends, said tub having at least one elongated agitator mounted therein for rotation about a horizontal axis, said agitator extending between said opposed ends of said tub and having means for urging products in contact therewith to move towards said first end of said tub in response to rotation of said agitator in a first direction and for urging products in contact therewith to move towards said second end of said tub in response to rotation of said agitator in a second and opposite direction, said method comprising:

(a) putting particulated products in said tub and to a level to be engaged by said agitator, (b) rotating said agitator in its first direction for a pre-determined length of time, (c) stopping said agitator, (d) rotating said agitator in its second direction for a predetermined length of time, (e) stopping said agitator, (f) continuously repeating steps (b)–(e) until said particulated products are blended to a desired degree.

2. A method of blending as set forth in claim 1, wherein steps (b) and (d) are each carried out for more than five seconds.

3. A method of blending as set forth in claim 2, wherein steps (b) and (d) are each carried out for no more than about one minute.

4. A method of blending as set forth in claim wherein steps (b) and (d) are approximately equal in duration.

5. A method of blending as set forth in claim 4, wherein steps (b) and (d) are each carried out for more than five seconds.

6. A method of blending as set forth in claim 5, wherein steps (b) and (d) are each carried out for no more than one minute.

7. A method of blending as set forth in claim 1, wherein step (d) is shorter in time than step (b).

8. A method of blending as set forth in claim 7, wherein step (d) is more than 25% as long as step (b).

9. A method of blending particulated products in a blender tub having first and second ends, said tub having first and second elongated agitators mounted side by side of each other for rotation about parallel horizontal axes, said agitators each extending between said opposed ends of said tub and each having means for urging products in contact therewith to move towards said first end of said tub in response to rotation of the agitator in a first direction and for urging products in contact therewith to move towards said second end of said tub in response to rotation of the agitator in a second, and opposite, direction, said method comprising:

(a) putting particulated products in said tub and to a level to be engaged by said agitators, (b) rotating said agitators in predetermined directions for predetermined lengths of time, (c) stopping said agitators, (d) rotating said agitators in directions opposite to that in step (b) and for predetermined lengths of time, (e) stopping said agitators, (f) continually repeating steps (b)–(e) until said particulated products are blended to a desired degree.

10. A method of blending as set forth in claim 9, wherein steps (b) and (d) are each carried out for more than five seconds.

11. A method of blending as set forth in claim 10, wherein steps (b) and (d) are each carried out for no more than about one minute.

12. A method of blending as set forth in claim 9, wherein during steps (b) the first agitator is rotated in its first direction and the second agitator is rotated in its second direction.

13. A method of blending as set forth in claim 12, wherein steps (b) and (d) are each carried out for more than five seconds.

14. A method of blending as set forth in claim 13, wherein steps (b) and (d) are each carried out for no more than about one minute.

15. A method of blending as set forth in claim 12 wherein steps (b) and (d) are approximately equal in duration.

16. A method of blending as set forth in claim 9, wherein during step (b) the first and second agitators are both rotated in their first direction, wherein step (d) is shorter in time than step (b), and wherein particulated products are continuously added to said tub during step (f).

17. A method of blending as set forth in claim 16, wherein step (d) is more than 25% as long as step (b).

18. A method of blending as set forth in claim 16, wherein the two agitators are stopped at different times relative to each other in steps (c) and (e).

19. A continuous blender comprising:

an elongated tub having opposed ends, one of which is the discharge end, and two side-by-side arcuate troughs extending between said ends, a pair of horizontal, elongated and parallel agitators disposed, one each, in said troughs, said agitators each having a rotatable shaft and means thereon for urging products in contact therewith to move in the same direction lengthwise of said tub when said agitator shafts are rotated in opposite directions, means for rotating said agitator shafts in opposite directions, means for repeatedly reversing the direction of rotation of said agitator shafts.

20. A continuous blender as set forth in claim 19 wherein said means on said agitator shafts comprise a ribbon wound helically around and along each of said shafts, one of said ribbons being wound in a right-hand direction and the other of said ribbons being wound in a left-hand direction.

21. A continuous blender as set forth in claim 20, wherein said shafts of said agitators are spaced closely enough to each other so that said ribbons intermesh with each other.

* * * * *

UNITED STATES PATENT AND TRADEMARK OFFICE

CERTIFICATE OF CORRECTION

PATENT NO. : 4,941,132

DATED : July 10, 1990

INVENTOR(S) : Darrell C. Horn and John M. Lennox, III

It is certified that error appears in the above-identified patent and that said Letters Patent is hereby corrected as shown below:

Column 8, line 36, between the words "claim" and "wherein" add the numeral "1".

Signed and Sealed this

Twelfth Day of September, 1995

*Attest:*

*Attesting Officer*

Bruce Lehman

BRUCE LEHMAN

*Commissioner of Patents and Trademarks*